United States Patent [19]

Muntjanoff

[11] 4,260,323

[45] Apr. 7, 1981

[54] GRAPPLE HEAD ARRANGEMENT

[75] Inventor: John R. Muntjanoff, Aurora, Ill.

[73] Assignee: Caterpillar Tractor Co., Peoria, Ill.

[21] Appl. No.: 88,721

[22] PCT Filed: Aug. 9, 1979

[86] PCT No.: PCT/US79/00584

§ 371 Date: Aug. 9, 1979

§ 102(e) Date: Aug. 9, 1979

[87] PCT Pub. No.: WO81/00396

PCT Pub. Date: Feb. 19, 1981

[22] Filed: Aug. 9, 1979

[51] Int. Cl.[3] ..... B66C 1/32

[52] U.S. Cl. ..... 414/731; 294/88; 294/106; 414/734; 414/739

[58] Field of Search ..... 414/729, 731, 732, 734, 414/738, 739; 294/88, 106

[56] References Cited

U.S. PATENT DOCUMENTS

| | | | |
|---|---|---|---|
| 2,604,220 | 7/1952 | Frischmann | 294/88 X |
| 3,048,288 | 8/1962 | Dwyer | 414/734 |
| 3,237,980 | 3/1966 | Helms | 294/88 X |
| 3,310,335 | 3/1967 | Shuey | 294/106 |
| 3,667,796 | 6/1972 | Funk | 294/88 |
| 3,972,431 | 8/1976 | Fischer | 414/731 |
| 4,005,894 | 2/1977 | Tucek | 414/731 X |
| 4,017,114 | 4/1977 | LaBounty | 294/88 |

*Primary Examiner*—Stephen G. Kunin
*Assistant Examiner*—Terrance L. Siemens
*Attorney, Agent, or Firm*—Wegner, Stellman, McCord, Wiles & Wood

[57] ABSTRACT

A compact grapple head (10) for use in apparatus such as a logging vehicle (11). The grapple head has a reduced overall height and utilizes four pivot connections (17,26,27 and 31) in controlling the tongs (13 and 18) thereof. The arrangement of the pivot connections relative to the tongs, an extensible device (22) and an interconnecting (28) provides an improved load-handling capability both as to maximum and minimum loads. Each of the extensible device (22) and link (28) is connected between the tongs with one of the pivotal connections (26) connecting both of the extensible device (22) and link (28) to one of the tongs (13) and a second pivotal connection (27) connecting both the extensible device and the other of the tongs (18) to the frame (12).

11 Claims, 4 Drawing Figures

GRAPPLE HEAD ARRANGEMENT

DESCRIPTION

1. Technical Field

This invention relates to grapple heads and more specifically to grapple heads such as may be used in conjunction with a logging vehicle.

2. Background Art

In U.S. Pat. No. 3,972,431 of Robert Louis Fischer, which patent is owned by the assignee hereof, a logging vehicle is illustrated having associated therewith apparatus including a grapple head adapted to grasp a group of logs for deployment thereof as desired. In said patent, the grapple head has a relatively substantial height which puts the log load input point in a disadvantageous position which in turn decreases the load carrying capacity of the vehicle. The grapple head utilizes an extensible means in the form of a piston cylinder device having one portion thereof connected to the frame of the grapple head and the other portion thereof connected to one of the tongs. Five pivot connections are provided in mounting the extensible means and tongs to the frame.

The grapple head is further limited in the amount of closure of the tongs and in the amount of spacing in the open arrangement thereof.

DISCLOSURE OF THE INVENTION

The present invention comprehends an improved grapple head structure providing an increased range of grasping spacing of the tongs. More specifically, in the grapple head of the present invention, the tongs may be arranged to close around a log of approximately 6"-diameter and to grasp a log or group of logs having an approximately 100" diameter.

The grapple head of the present invention is further arranged to have decreased height relative to the grapple heads of the prior art which significantly improves the point of load input into the vehicle thereby increasing the carry capacity.

The grapple head of the present invention is extremely simple and economical of construction, utilizing only four pivot connections in pivotally mounting the tongs and extensible means thereof to the grapple head frame.

More specifically, the grapple head of the present invention includes a frame, a first tong having a first portion, a second portion spaced from the first portion, and a third portion intermediate the first and second portions, first pivot means pivotally mounting the intermediate third portion to the frame, a second tong having a first portion, a second portion spaced from the first portion thereof, and a third portion intermediate the first and second portions thereof, extensible means having first and second adjustably spaceable portions, second pivot means pivotally connecting one of the spaceable portions to the first tong first portion, third pivot means pivotally connecting the second tong first portion to the frame and the other of the spaceable portions to the second tong first portion and the frame, a link having first and second connecting portions, the link first portion being pivotally connected to the first tong first portion by the second pivot means, and a fourth pivot means pivotally connecting the link second portion to the second tong third portion, whereby the tong second portions define adjustably apposed grasping means controlled by the adjusted arrangement of the extensible means connected between the link first portions.

In the illustrated embodiment, the first portions of each of the tongs comprises an end portion thereof.

In the illustrated embodiment, the intermediate portions of the tongs are disposed adjacent the first end portions.

In the illustrated embodiment, the tong first end portions are bifurcated with the link ends being connected to the pivot means between the spaced bifurcated portions of the tong ends.

BEST MODE FOR CARRYING OUT THE INVENTION

Figure 1:
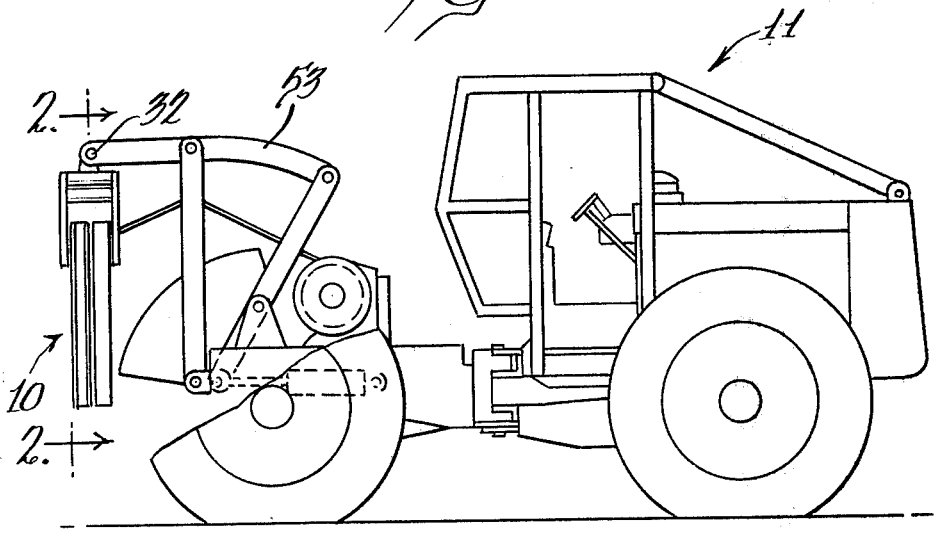
FIG. 1 is a fragmentary side elevation of a logging vehicle having an improved compact grapple head embodying the invention.

In the exemplary embodiment of the invention as disclosed in the drawing, an improved grapple head generally designated 10 is shown for use as in a logging vehicle generally designated 11. The grapple head 10 is arranged to have a relatively low height so as to permit an improved location of load input into the vehicle as compared to the arrangement thereof with the conventional prior art grapple head structures.

Figure 2:
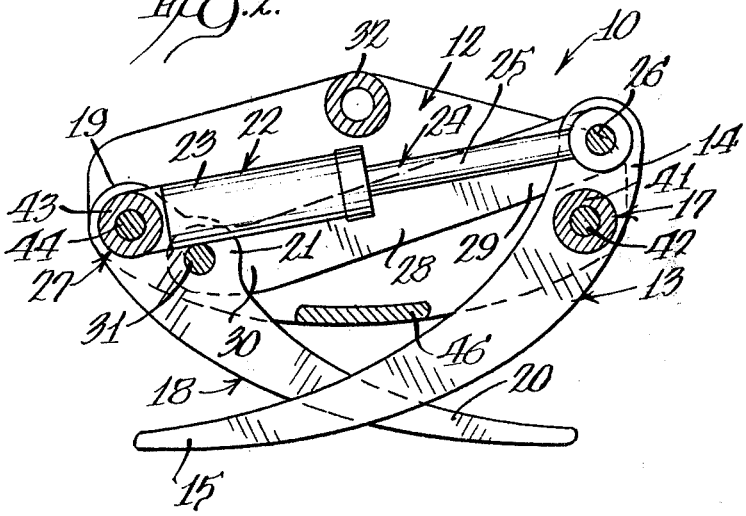
FIG. 2 is an enlarged vertical section taken substantially along the line 2—2 of FIG. 1.
Figure 3:
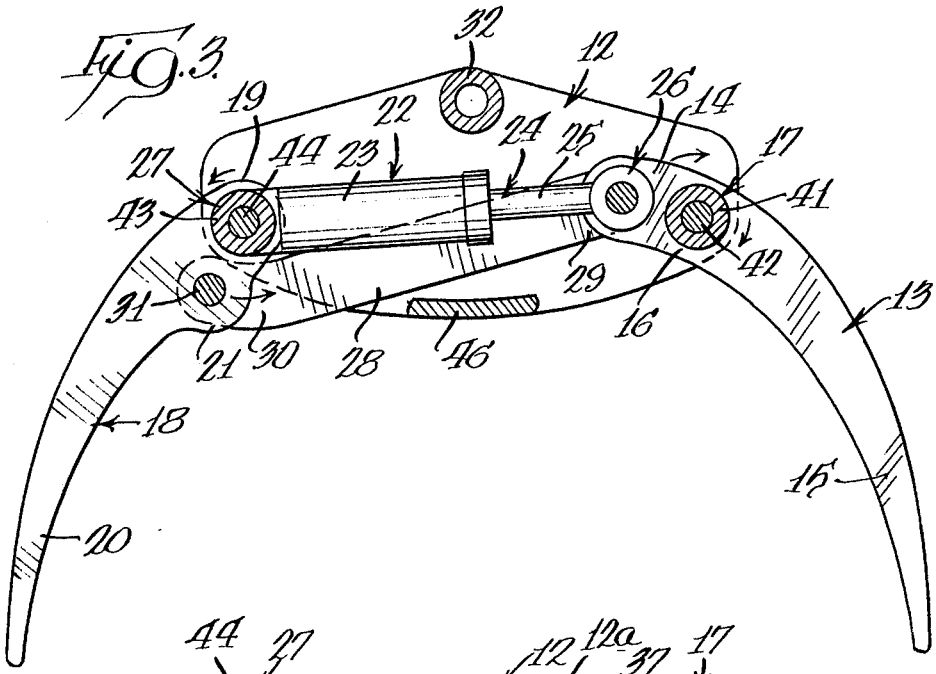
FIG. 3 is a vertical section similar to that of FIG. 2 but with the grapple head in the open arrangement.
Figure 4:
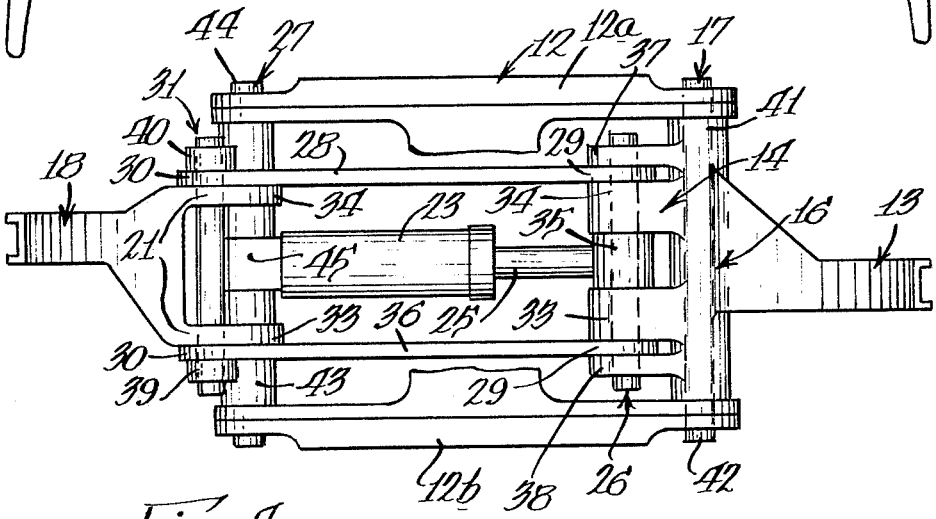
FIG. 4 is a fragmentary top plan view of the grapple head in the extended arrangement of FIG. 3.

Referring more specifically to the illustration of the grapple head 10 of FIGS. 2–4, the grapple head includes a frame 12. As shown in FIG. 4, the frame includes a pair of spaced plates **12*a* and 12*b***.

A first tong 13 is provided having a first end portion 14, a second, grasping end portion 15, and an intermediate portion 16. A first pivot means generally designated 17 is provided for pivotally mounting the intermediate portion 16 of the first tong 13 to the frame 12.

A second tong 18 is provided with a first end portion 19, a second, grasping end portion 20, and an intermediate portion 21.

An extensible means generally designated 22 is provided, which, in the illustrated embodiment, comprises a fluid-operated device including a cylinder 23 and a piston means 24 provided with a piston rod 25 extending to outwardly of the cylinder 23. Thus, as shown, the extensible means 22 defines first and second adjustably spaceable portions 23 and 25 respectively.

A second pivot means 26 is provided for pivotally connecting the piston rod 25 to the end portion 14 of first tong 13.

A third pivot means 27 is provided for pivotally connecting end portion 19 of the second tong 18 to frame 12 and pivotally connecting the cylinder 23 of extensible means 22 to end portion 19 of the second tong 18. Thus, pivot means 27 further effectively pivotally connects the cylinder 23 to frame 12.

A link 28 is provided having a first connecting portion 29 pivotally connected to portion 14 of tong 13 by pivot means 26. The link opposite end portion 30 of the link 28 is pivotally connected to the intermediate portion 21 of second tong 18 by a fourth pivot means generally designated 31.

As shown, the intermediate portions 16 and 21 of the tongs 13 and 18, respectively, may be disposed adjacent the end portions 14 and 19 thereof so as to provide a relatively large sweep of the grasping portions 15 and 20 of the respective tongs. Thus, as shown in FIG. 3, the tongs may be spaced widely apart in the open arrangement and, illustratively, may have a spacing between their opposite tips of approximately 100 inches. As shown in FIG. 2, the tongs may be brought into overlapping relationship so as to embrace a relatively small diameter log, such as one having a diameter of approximately 6 inches. Such improved range of the tong arrangement is provided by the improved arrangement of the pivot connections as discussed above.

As shown in FIGS. 2 and 3, the frame may include a hanging portion 32 for mounting the grapple head to a suitable support 53, as shown in FIG. 1.

As shown in FIG. 4, tong end 14 may define a bifurcated portion including a pair of spaced portions 33 and 34, pivot means 26 defining a pivot pin extending therethrough with the piston rod 25 defining a connecting end portion 35 pivotally mounted to the pivot means 26 between the bifurcated spaced portions 33 and 34 of the tong end 14.

As further shown in FIG. 4, a second link 36 may be provided arranged and connected substantially similarly to link 28. Links 28 and 36 may be disposed outboard of the tong portions 33 and 34 and, as shown in FIG. 4, the tong end 14 may further define outboard portions 37 and 38 disposed outboard of the links 28 and 36 respectively.

Pivot means 31 includes outboard retainer portions 39 and 40 outboard of the opposite ends of the links 28 and 36 respectively.

More specifically, pivot means 17 may include a tubular portion 41 defined by the intermediate portion 16 of first tong 13, and a pivot pin 42 extending through portion 41 and the spaced frame plates **12*a* and 12*b***.

Pivot means 27 may include a tubular element 43 coaxially receiving a pivot pin 44. The cylinder 23 may be provided with a connector 45 connected to the pin 44.

A cross plate 46 may be provided extending between the frame portions **12*a* and 12*b***.

Industrial Applicability

As indicated above, the grapple head is advantageously adapted for use in connection with logging vehicles and the like. One such vehicle is illustrated in U.S. Pat. No. 3,972,431 discussed above, and the grapple head of the present invention provides an improved grapple head construction for use therein, as discussed above.

In operation, the extensible device 22 is suitably actuated so as to selectively position the tong end portions 14 and 19 to thereby space the grasping tong portions 15 and 20 as desired. As the extensible device 22 is connected between the tong end portions 14 and 19, and the other tong and link pivot connections are arranged as discussed above, an improved wide range of graspability is provided in the grapple head, as discussed above.

The improved arrangement further decreases the overall height of the grapple head so as to correspondingly permit a lowered load input point to the logging vehicle with which it may be employed. In reducing the number of pivot points, as discussed above, simplified maintenance and long life are provided.

The improved compact arrangement of the grapple head provides facilitated utilization in effecting the logging operation.

The ability of the improved grapple head to handle a wider range of load sizes further facilitates the logging operation.

Thus, the grapple head of the present invention is extremely simple and economical of construction while yet providing the highly desirable features discussed above.

Other aspects, objects and advantages of this invention can be obtained from a study of the drawings, the disclosure and the appended claims. The foregoing disclosure of specific embodiments is illustrative of the broad inventive concepts comprehended by the invention.

I claim:

1. A compact grapple head (10) comprising:

a frame (12);

a first tong (13) having a first portion (14), a second portion (15) spaced from said first portion, and a third portion (16) intermediate said first and second portions;

first pivot means (17) pivotally mounting said intermediate third portion (16) to said frame (12);

a second tong (18) having a first portion (19), a second portion (20) spaced from said first portion thereof, and a third portion (21) intermediate said first and second portions thereof;

extensible means (22) having first (23) and second (24) adjustably spaceable portion;

second pivot means (26) pivotally connecting one (24) of said spaceable portions to said first tong first portion (14), said second pivot means defining a pivot pin;

third pivot means (27) pivotally connecting said second tong first portion (19) to said frame (12) and the other of said spaceable portions (23) to said second tong first portion (19) and said frame (12);

a link (28) having first (29) and second (30) connecting portions, said link first portion (29) being pivotally connected to said first tong first portion (14) by said pivot pin of the second pivot means (26); and a fourth pivot means (31) pivotally connecting said link second portion (30) to said second tong third portion (21), whereby said tong second portions (15,20) define adjustably opposed grasping means controlled by the adjusted arrangement of said extensible means (22) connected between said tong first portions (14,19).

2. The grapple head of claim 1 wherein said intermediate third portion (16) of said first tong (13) is disposed closely adjacent said first portion (14) thereof.

3. The grapple head of claim 1 wherein said intermediate third portion (21) of said second tong (18) is disposed closely adjacent said first portion (19) thereof.

4. The grapple head of claim 1 wherein said extensible means (22) comprises a fluid-operated device having a cylinder (23) connected to one of said link first portions (14,19) and a piston rod (25) connected to the other (19,14) of said tong first portions.

5. A compact grapple head (10) comprising:

a frame (12);

a first tong (13) having a first end portion (14), a second opposite end portion (15), and a third portion (16) intermediate said first and second end portions thereof;

first pivot means (17) pivotally mounting said intermediate third portion (16) to said frame (12);

a second tong (18) having a first portion (19) a second portion (20) spaced from said first portion thereof, and a third portion (21) intermediate said first and second portions thereof;

extensible means (22) having first (23) and second (24) adjustable spaceable portions;

second pivot means (26) pivotally connecting one (24) of said spaceable portions to said first tong first end portion (14), said second pin means defining a pivot pin;

third pivot means (27) pivotally connecting said second tong first end portion (19) to said frame (12) and the other of said spaceable portions (23) to said second tong first end portion (19) and said frame (12);

a link (28) having first (29) and second (30) connecting portions, said link first connecting portion (29) being pivotally connected to said first tong first end portion (14) by said pivot pin of the second pivot means; and a fourth pivot means (31) pivotally connecting said link second portion (30) to said second tong intermediate third portion (21), whereby said tong second end portions (15,20) define adjustable opposed grasping means controlled by the adjusted arrangement of said extensible means (22) connected between said tong first end portions (14,19).

6. The grapple head of claim 5 wherein said tong first end portions (14,19) are bifurcated, each defining spaced pivot connections (33,34), said extensible means (22) being connected to said second and third pivot means (26,27) intermediate said spaced tong pivot connections.

7. The grapple head of claim 5 wherein a second link (36) is provided having first and second connecting portions (29,30), said link first connecting portion (29) being pivotally connected to said first tong first end portion (14) by said second pivot means (26) and said second link second connecting portion (20) being pivotally connected to said second tong intermediate third portion (21) by said fourth pivot means (31).

8. A compact grapple head (10) comprising:

a frame (12);

a first tong (13) having a first end portion (14), a second opposite end portion (15), and a third portion (16) intermediate said first and second end portions thereof;

first pivot means (17) pivotally mounting said intermediate third portion (16) to said frame (12);

a second tong (18) having a first portion (19) a second portion (20) spaced from said first portion thereof, and a third portion (21) intermediate said first and second portions thereof;

extensible means (22) having first (23) and second (24) adjustable spaceable portions;

second pivot means (26) pivotally connecting one (24) of said spaceable portions to said first tong first end portion (14);

third pivot means (27) pivotally connecting said second tong first end portion (19) to said frame (12) and the other of said spaceable portions (23) to said second tong first end portion (19) and said frame (12);

a link (28) having first (29) and second (30) connecting portions, said link first connecting portion (29) being pivotally connected to said first tong first end portion (14) by said second pivot means; and a fourth pivot means (31) pivotally connecting said link second portion (30) to said second tong intermediate third portion (21), whereby said tong second end portions (15,20) define adjustable opposed grasping means controlled by the adjusted arrangement of said extensible means (22) connected between said tong first end portions (14,19), said tong first end portions (14,19) being bifurcated, each defining spaced pivot connections (33,34), said extensible means (22) being connected to said second and third pivot means (26,27) intermediate said spaced tong pivot connections, a second link (36) being provided having a first and second connecting portions, said second link first connecting portion being pivotally connected to said first tong first end portion (14) by said second pivot means (26) and said second link second connecting portion being pivotally connected to said second tong intermediate third portion (21) by said fourth pivot means (31), said links (28,36) being connected to said second (26) and fourth (31) pivot means outboard of said tong spaced pivot connections (33,34).

9. A compact grapple head (10) comprising:

a frame (12);

a first tong (13) having a first end portion (14), a second opposite end portion (15), and a third portion (16) intermediate said first and second end portions thereof;

first pivot means (17) pivotally mounting said intermediate third portion (16) to said frame (12);

a second tong (18) having a first portion (19) a second portion (20) spaced from said first portion thereof, and a third portion (21) intermediate said first and second portions thereof;

extensible means (22) having first (23) and second (24) adjustable spaceable portions;

second pivot means (26) pivotally connecting one (24) of said spaceable portions to said first tong first end portion (14);

third pivot means (27) pivotally connecting said second tong first end portion (19) to said frame (12) and the other of said spaceable portions (23) to said second tong first end portion (19) and said frame (12);

a link (28) having first (29) and second (30) connecting portions, said link first connecting portion (29) being pivotally connected to said first tong first end portion (14) by said second pivot means;

a fourth pivot means (31) pivotally connecting said link second portion (30) to said second tong intermediate third portion (21), whereby said tong second end portions (15,20) define adjustable opposed grasping means controlled by the adjusted arrangement of said extensible means (22) connected between said tong first end portions (14,19); and a second link (36) having first and second connecting portions (29,30), said second link first connecting portion (29) being pivotally connected to said first tong first end portion (14) by said second pivot means (26) and said second link second connecting portion being pivotally connected to said second tong intermediate third portion (21) by said fourth pivot means (31), said first tong first end portion (14) further defining outboard portions (37,38) disposed outboard of said first link connecting portion (29).

10. A grapple head (10) providing a frame (12) pivotally mounting a pair of tongs (13,18) having opposite article grasping (15,21) and control ends (14,19) with a rigid link (28) pivotally interconnecting said control ends of the tongs, the improvement comprising:

powered extensible means (22) interconnected between the control ends of the tongs; and pivot means pivotally mounting the tongs for pivotal movement of their article grasping ends in opening and closing relation to each other as an incident of adjustable extension of the extensible means.

11. The grapple head of claim 10 wherein said tongs (13,18) are pivotally mounted to the frame (12) to be swung to a relatively wide open position and to a relatively compact closed position with the article grasping ends (15,20) of the tongs disposed in substantially overlapped criss-crossing relation closely adjacent to said frame (12).

* * * * *